US009796933B2

(12) United States Patent
Mao

(10) Patent No.: US 9,796,933 B2
(45) Date of Patent: Oct. 24, 2017

(54) PROCESS FOR PURIFYING PETROLEUM CRUDE OILS

(71) Applicant: Phillips 66 Company, Houston, TX (US)

(72) Inventor: Zhenhua Mao, Bartlesville, OK (US)

(73) Assignee: Phillips 66 Company, Houston, TX (US)

( * ) Notice: Subject to any disclaimer, the term of this patent is extended or adjusted under 35 U.S.C. 154(b) by 0 days.

(21) Appl. No.: 14/969,064

(22) Filed: Dec. 15, 2015

(65) Prior Publication Data

US 2016/0177198 A1 Jun. 23, 2016

Related U.S. Application Data

(60) Provisional application No. 62/093,576, filed on Dec. 18, 2014, provisional application No. 62/093,668, filed on Dec. 18, 2014, provisional application No. 62/093,690, filed on Dec. 18, 2014, provisional application No. 62/093,708, filed on Dec. 18, 2014, provisional application No. 62/093,722, filed on Dec. 18, 2014, provisional application No. 62/093,797, filed on Dec. 18, 2014, provisional application No. 62/093,832, filed on Dec. 18, 2014.

(51) Int. Cl.

| | |
|---|---|
| ***C10G 25/12*** | (2006.01) |
| ***C10G 25/00*** | (2006.01) |
| ***C10G 31/09*** | (2006.01) |
| ***C10G 31/00*** | (2006.01) |
| ***C10G 25/06*** | (2006.01) |

(52) U.S. Cl.
CPC ..... *C10G 25/003* (2013.01); *C10G 25/06* (2013.01); *C10G 25/12* (2013.01); *C10G 31/00* (2013.01); *C10G 31/09* (2013.01); *C10G 2300/1033* (2013.01); *C10G 2300/201* (2013.01); *C10G 2300/208* (2013.01)

(58) Field of Classification Search
None
See application file for complete search history.

(56) References Cited

U.S. PATENT DOCUMENTS 4,201,665 A * 5/1980 Savage ..... C02F 1/281 210/673
2012/0132566 A1* 5/2012 Janssen ..... C10G 25/003 208/86

OTHER PUBLICATIONS

M. H. L. Ribeiro et al., Kinetics of Selective Adsorption of Impurities From a Crude Vegetable Oil in Hexane to Activated Earths and Carbons, 213 Eur. Food Res. Technol. 132-138 (2001).*

* cited by examiner

*Primary Examiner* — Randy Boyer
(74) *Attorney, Agent, or Firm* — Phillips 66 Company

(57) ABSTRACT

The invention relates to removing contaminants from oil using solid sorbents that are comprised primarily of carbon and preferably of coke particles. The coke particles have an affinity for contaminants in oil and are sized to be filtered from oil without plugging. Most contaminants have such a small size that they tend to plug up filters. As the contaminants agglomerate onto the solid sorbent, the resulting particles form a filter cake on conventional filter materials in such a way as to allow the oil to pass on through without significant pressure drop or delay.

17 Claims, 2 Drawing Sheets

PROCESS FOR PURIFYING PETROLEUM CRUDE OILS

CROSS-REFERENCE TO RELATED APPLICATIONS

This application is a non-provisional application which claims benefit under 35 USC §119(e) to U.S. Provisional Application Ser. No. 62/093,576 filed Dec. 18, 2014, entitled "Sorbents for Removing Solid Particles from Crude Oil", to U.S. Provisional Application Ser. No. 62/093,668 filed Dec. 18, 2014, entitled "A Mixture of Crude Oil and Solid Hydrocarbon Particles", to U.S. Provisional Application Ser. No. 62/093,690 filed Dec. 18, 2014, entitled "A Mixture of Crude Oil and Solid Hydrocarbon Particles", to U.S. Provisional Application Ser. No. 62/093,708 filed Dec. 18, 2014, entitled "A System for Purifying Crude Oils", to U.S. Provisional Application Ser. No. 62/093,722 filed Dec. 18, 2014, entitled "A System for Regenerating Adsorbents for Purifying Crude Oils", to U.S. Provisional Application Ser. No. 62/093,797 filed Dec. 18, 2014, entitled "Upgrading Biofuel Crude Oils with Solid Sorbents for Petroleum Refinery Processing", and to U.S. Provisional Application Ser. No. 62/093,832 filed Dec. 18, 2014, entitled "A Process for Purifying Petroleum Crude Oils", all of which are incorporated herein in its entirety.

STATEMENT REGARDING FEDERALLY SPONSORED RESEARCH OR DEVELOPMENT

None.

FIELD OF THE INVENTION

This invention relates to removing salts and other matter from raw crude oil prior to refining the crude oil and especially to systems and processes for capturing salts and other solid material contaminants that might cause corrosion or fouling within refinery systems.

BACKGROUND OF THE INVENTION

Raw crude oil generally contains undesirable impurities including inorganic and organic solids, salts, water droplets, unstable large polar molecules etc. which are the root causes for various fouling on processing equipment in refinery production. Equipment fouling is broadly defined as reduced production efficiency such as reduced throughput because of solid deposition on liquid transfer pipes and increased energy consumption because of reduced thermal transfer efficiency through thermal process walls. Equipment fouling due to the precipitation of the undesirable materials occur at various processing stages in petroleum refineries such as crude hot train exchanger, atmospheric towers, vacuum furnace and vacuum tower, coker furnaces, and hydro and thermal cracking units, results in substantial efficiency losses. It is desirable to remove these undesirable materials in crude oil before the crude oil is put through the subsequent thermal processes.

Inorganic salts typically include various metal chlorides, sulfides, and oxides etc. such as calcium, sodium and magnesium chlorides and other particulates. Salts cause corrosion in refinery systems that are expensive to repair and require more frequent shutdown and longer turn-around before profitable operation resumes. Corrosion is caused primarily by hydrochloric acid (produced from the hydrolysis of salts at high temperatures) in crude oil distillation columns and overhead systems. Since salts in crude oils are a significant problem and concern, removing such salts is an important operational process in a refinery.

Typically, desalting crude oil involves adding water to the incoming crude oil emulsifying the water and oil by shearing across a globe valve, which is also known as a mix-valve and allowing the oil and water to separate in a desalter settling vessel. The salt preferentially and fairly rapidly dissolves into the water immediately following the mix-valve so the remaining step is to separate the water from the oil. The oil and water are separated based on their density differences. Desalted crude exits from the top of the desalter settling vessel to the crude distillation tower while effluent water or brine exits from the bottom. However, desalting heavy crude oil in a refinery desalter system is challenging due to the relatively high viscosity of heavy crude and relatively high densities of heavy crude oil relative to the water with the captured salt. Moreover, water and oil emulsions for heavy crude oil tend to be more stable than for light oil and stable emulsions make desalting less successful or at least more difficult.

Because of the chemical incompatibility of crude oil, organic solids, and water, the separation of crude oil and water emulsions in many cases does not remove impurity solids into the water phase from crude oil. With extreme variation of chemical constituents of crude oils, there is not a universal demulsifier for crude oil/water emulsions to help provide for oil/water separation. Existing desalting processes are not only inefficient for removing undesirable impurities in crude oil, they may also create additional undesirable waste such as stable crude oil/water emulsions and increased solid and water content in crude oil. In addition, current desalting processes use a large amount of fresh water (>4% based on crude oil) and chemicals such as demulsifiers and wetting agents etc., such that the resulting water contains dissolved salts, oil droplets, and other organic solids. Disposing such contaminated water adds significant cost to the desalting process.

It has been known in the refinery industry that specific fouling problems such as those at atmospheric and coker furnaces can be mitigated by removing organic solid and inorganic solids in crude oil and feed heavy oil. However, there is not any practical process to remove such solids from crude oil. Even at a laboratory scale, removing such solids by filtration is not practically feasible because the solids in crude oil would clog up the filter quickly as the solids in crude oil exist in colloidal particles coated with sticky organic compounds. There is no known practical method to remove organic solids in crude oils.

Some crude oils contain large and polar compounds which are inherently unstable in the crude oils. When such crude oil comes into contact with the wall of processing equipment, such as in an atmospheric or coker furnace, those compounds tend to precipitate out forming a thermally insulating layer on the wall and resulting in a drastic reduction in thermal transfer efficiency. There is not any known practical process to remove these large unstable compounds to prevent such equipment fouling.

Any improvement to removing impurities from crude oil would be very desirable for refineries.

BRIEF SUMMARY OF THE DISCLOSURE

The invention more particularly relates to a process for removing contaminants and basic or alkaline species contaminants from crude oil. A solid sorbent is added to crude oil where at least some of the solid sorbent has been partially oxidized. Solid contaminants are agglomerated/adsorbed from the crude oil onto the solid sorbent wherein basic or alkaline species contaminants are also adsorbed to the oxidized solid sorbent. The solid sorbent with agglomerated contaminants is then separated from the crude oil.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Figure 1:
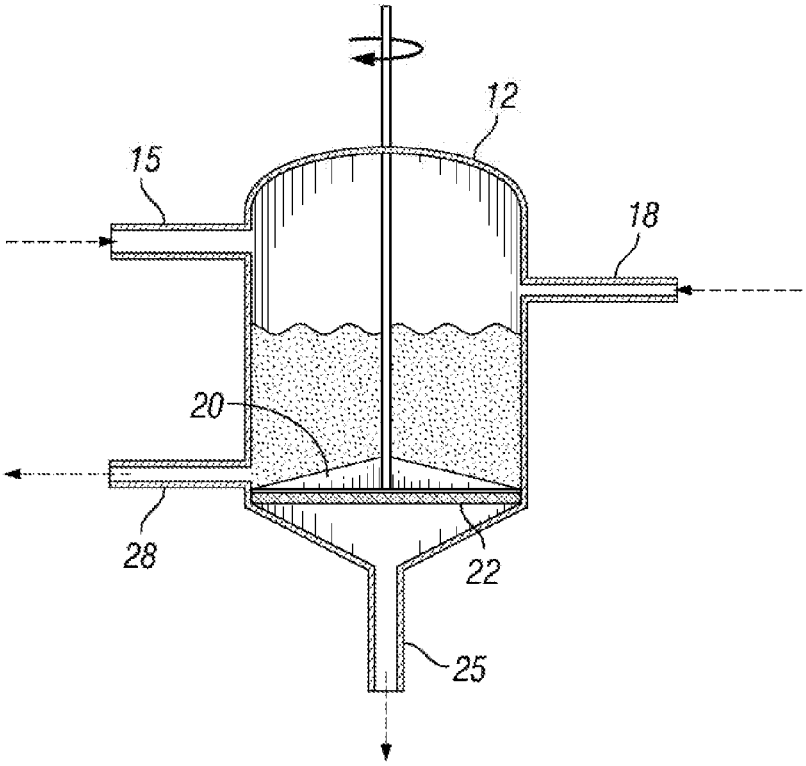
FIG. 1 is a schematic drawing of a first embodiment of process for removing contaminants from oil.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The present invention relates to the discovery of using particulate green coke as a solid sorbent for impurities in crude oil. Solid sorbents eliminate the challenging problem of current technologies of using highly dispersed water to collect salts in crude where the water is so highly dispersed that it is a challenge to then separate the water back from the crude. The solid sorbents of the present invention are sized to be easily separated from crude oil by filtration.

Crude oil commonly includes contaminants and other undesirable materials that cause problems for refineries. These contaminants come in many varieties including organic and non-organic solids, salt containing water droplets, and large polar molecules that are inherently unstable in the liquid phase at treatment temperatures within a refinery. Those unstable compounds tend to preferably precipitate out to form solids when they come to contact with equipment surface on the process equipment. The solid particulates tend to be quite small or fine occurring at about one micron and typically much less. To the extent that one might try to separate these contaminants by filtration, the filter element would have to be an exceptionally fine mesh. Such a fine mesh is quite vulnerable to plugging creating an unacceptably high pressure drop and slow flow rate through such filters. Other contaminants have an organic nature and are suspended in the crude oil forming a colloid. Some contaminants include inorganic solid particles with organic molecules on the surface.

Through many years of research on organic and pitch chemistry, particularly related to the precipitation of pitch solid particles in pitch-organic solvent systems, the inventor discovered that some solid particles such as green coke particles exhibit the ability to effectively absorb ultrafine organic particle along with unstable large compounds. The resulting solid particles can be easily separated from the liquid by filtration. This invention provides an effective method for the simultaneous removal of organic and inorganic solids, salts, undesirable compounds in crude oil with solid particles.

Green coke, as a surface/sorbent, is chemically similar to the impurity solid particles and unstable compounds in the crude oil. As such, it tends to agglomerate with and adsorb these organic contaminants forming larger particles. These particles also tend to capture water droplets and thereby gather the salt as the water droplet in crude oils are typically covered with large polar molecules, which is akin to the surface of sorbent and adsorbed particles. These now larger particles, especially considering that they have the underlying size and consistency of the coke, are amenable to being removed from the crude oil by filtration having a mesh that allows relatively high flow rates. Once filtered, the crude oil has been found to have significantly diminished amounts of contaminants.

The green coke particles that are mixed in to the crude to capture contaminants are sized or selected having an average particle size of at least 1 micron up to about 250 microns, with particles being between 5 and 50 microns being more preferred. The green coke is mixed into the raw crude oil and thoroughly dispersed to provide for as much contact with contaminates as can be efficiently accomplished.

As shown in FIG. 1, the crude oil is directly to a mixing tank 12 from a supply line 15. The solid sorbent is added at delivery station 18 and the mixture of raw crude oil and solid sorbent is blended by agitator 20. The mixture of crude oil having the solid sorbent thoroughly dispersed therein is then separated by filter element 22 allowing the econtaminated crude to pass through outlet 25 while wet solid sorbent with agglomerated contaminants thereon are allowed out through contaminant outlet 28.

Figure 2:
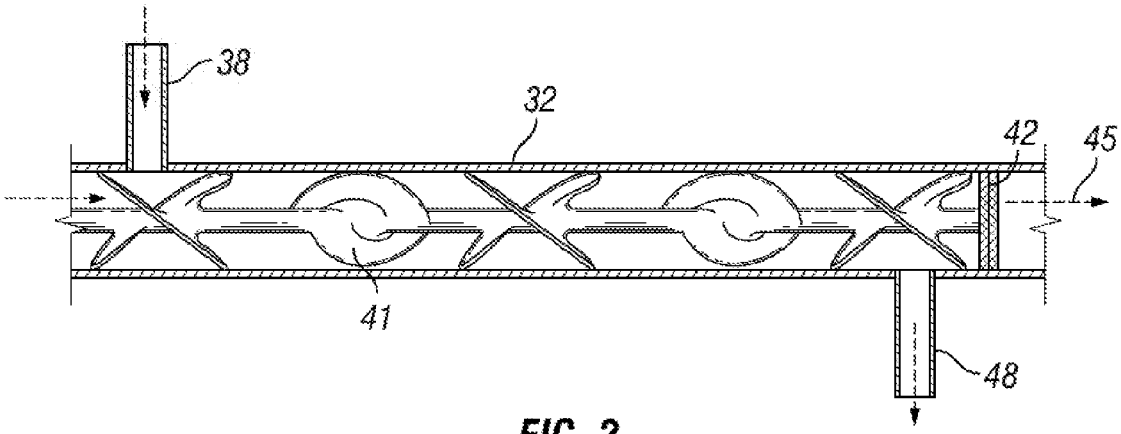
FIG. 2 is a schematic drawing of a second embodiment of the process of separating contaminants of oil.

It should be understood that a number of embodiments for the inventive system may be defined such as shown in FIG. 2 where a section of pipe 32 for transporting crude oil includes an inlet 38 for sorbent. The sorbent is blended and dispersed through the crude oil via a static mixer 41. A filter element 42 is positioned at the end of the pipe section 32 defining a crude outlet 45 and a contaminant outlet 48. The pipe section 32 may be horizontal, vertical with the flow going up or down or any other angle. The filter element 42 may be perpendicular to the flow of the oil through the pipe section 32, perpendicular to the pipe section 32 (such as in the side walls) or any other practical orientation in the pipe section 32. Similarly, the contaminant outlet may also be arranged at an angle to the pipe section or straight out the end.

The crude oil mixture comprises between 95% and 99.9% crude oil and between 0.05% and 5% green petroleum coke solid sorbent. The green petroleum coke solid sorbent has an average size between about 2 microns and about 50 microns although sizes between about 5 microns and about 15 are generally preferred. The mass ratio of crude oil to sorbent may be maintained at a ratio of at least 1 kg sorbent to 500 kg of crude oil. More preferably, the crude oil would include a higher ratio of sorbent such that at least 5 kg of sorbent would be thoroughly mixed with 500 kg of crude oil such that the ratio is 100:1. The ratio may include up to 1 kg of sorbent to 2 kg of crude oil when the crude oil is heavily laden with contaminants, but as a practical matter, it is more likely that the ratio will be between 100:1 and 10:1. The composition may be maintained at a temperature that is elevated above average room temperature but less than 200° C.

The density of the sorbent is preferably between 0.5 g/cc and 7 g/cc and more preferably between 0.7 g/cc and 2.0 g/cc. The sorbent particles are partially or almost totally hydrocarbon materials that contain a residual carbon content of at least 40%, preferably between 75% and 99%, more preferably between 85% and 98%. The residual carbon content is defined by ASTM D7662-13. The average particle size of the sorbent is between 1 and 500 micron, preferably between 1 and 50 micron, and more preferably between 3 and 50 micron.

Figure 3:
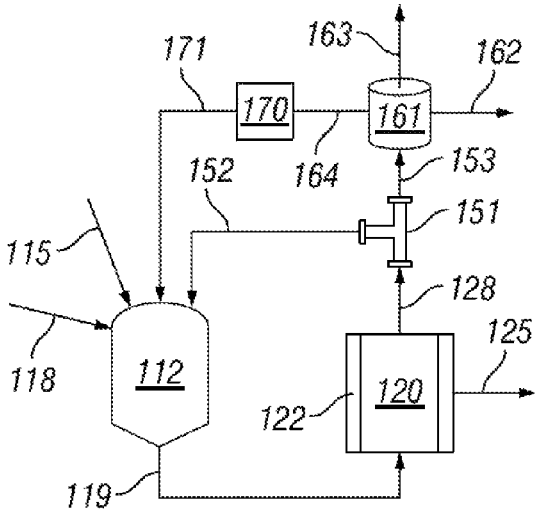
FIG. 3 is a schematic drawing of a third embodiment of a process for separating contaminants of oil including a system for activating the solid sorbent to have an affinity for basic species contaminants.

The wet green coke with the agglomerated/adsorbed contaminants may be processed for re-use. As shown in FIG. 3, a mixing tank 112 is provided for mixing crude oil and solid adsorbent. Crude oil is supplied at inlet 115 and fresh adsorbent is supplied at inlet 118. After mixing using a suitable mixing technology, the mixture is conveyed via line 119 to separation device 120 including filter media 122. While one separation device 120 is shown, it should be understood that multiple such devices may be included where some are in use having a filter cake formed on the media 122 while other separation devices 120 are offline having the filter cake flushed or back-flushed for further treatment. The cleaned crude oil is removed through outlet 125 and carried on for further processing in the refinery and the crude laden adsorbent exits via line 128. The sorbent is subjected to further separation at sorbent separator 151. Some solid sorbent 152 is returned to the mixing tank 112 while remaining sorbent with crude is delivered to regenerator 161 via line 153. While the amount of crude with the sorbent in sorbent regenerator 161 is small compared to the crude recovered at outlet 125, clean crude is discharged through outlet 162 and directed for further processing in the refinery. Solid waste is discharged via outlet 163 which is preferably disposed on continuous basis. The re-generation process includes recovery of liquid oil and thermal treatment of the solid material to liberate or pyrolize the contaminants. The wet sorbent after adsorption first goes through evaporation to recover the liquid oil at an elevated temperature either under reduced atmosphere pressure or at ambient pressure. The dried solid powder is subjected to the specific thermal treatment either under reduced atmosphere pressure or at a pressure less than 15 psi. The sorbent is subjected to regenerating temperatures that are at least 100° C., preferably between 100° C. and 1000° C., more preferably between 200° C. and 750° C., even more preferably between 250° C. and 550° C. The atmosphere for the thermal treatment is preferably inert; nitrogen gas and other hydrocarbon gas are preferred.

Regenerated green coke sorbent is delivered to the mixing tank 112 via line 164 and 171. It is noted that a device 170 is shown for providing an alternative treatment for the sorbent as will be described below. The regenerated coke sorbent attains substantial amounts of its sorbent functionality through regeneration, but the step typically includes some selection by sizing eliminating sorbent particles that have attritted down to an unacceptable size and eliminated from the process through discharge 163. Using recycled sorbent is a low cost way to reuse sorbent that provides some level of sorbent function, but especially helps by increasing the available surface area within the crude mixing tank so as to create many contact opportunities by the sorbent and the contaminants.

Figure 4:
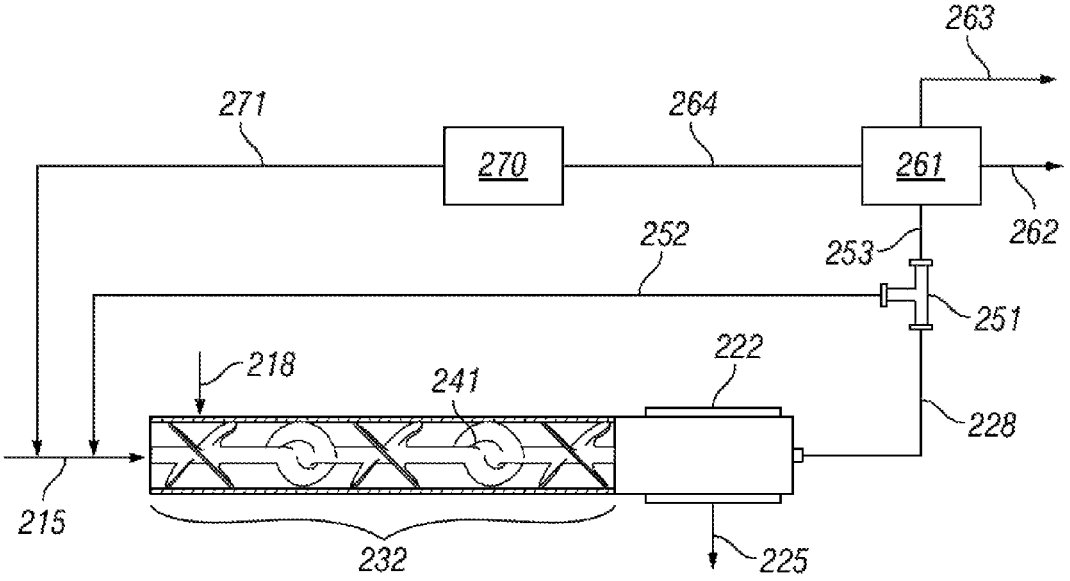
FIG. 4 is a schematic drawing of a fourth embodiment of a process for separating contaminants of oil including a system for activating the solid sorbent to have an affinity for basic species contaminants.

The process may further be accomplished with a system having a different appearance but similar operations as shown in FIG. 4 where the crude oil enters a mixing area 232 via inlet 215. Fresh green coke sorbent is delivered via inlet 218. The sorbent and crude oil are mixed together by a mixer 241, such as a static mixing element as shown. The cleaned or decontaminated crude exits through outlet 225 after passing through filter media 222. The crude laden sorbent is carried on through line 228 for further separation at sorbent separator 251. Some solid sorbent 252 is returned to the mixing zone 232 while remaining sorbent with crude is delivered to regenerator 261 via line 253. While the amount of crude with the sorbent in sorbent regenerator 261 is small compared to the crude recovered at outlet 225, clean crude is discharged through outlet 262 and directed for further processing the refinery. The re-generation process includes recovery of liquid oil and thermal treatment of the solid material. The wet sorbent after adsorption first goes through evaporation to recover the liquid oil at an elevated temperature either under reduced atmosphere pressure or at ambient pressure. Regenerated green coke sorbent is delivered to the mixing zone 232 via line 264 and 271. Device 270 provides an optional treatment for the sorbent as described below. The regenerated coke sorbent attains substantial amounts of its sorbent functionality through regeneration, but the step typically includes some selection by sizing eliminating sorbent particles that have attritted down to an unacceptable size and eliminated from the process through discharge 263.

Example 1

As an example of this process, two common crude oils were mixed together using 180 grams of WCS (West Canadian Sour)) crude oil and 120 grams of Bakken crude oil were mixed together to form a mixture and then split into two. A 150 gram sample of the mixture was mixed with 3 grams of a green coke powder in a 500 ml Erlenmeyer flask on a hot plate with a magnetic bar. After the mixture temperature reached 70° C., the mixture was poured into a filtration flask (9 cm in diameter) and filtered through a 0.45 μm Nylon filter membrane. The filtrate was collected as solid-removed crude oil blend. The filtration cake was washed thoroughly with toluene, dried under Vacuum at 110° C. The dried powder was used again with the other 150 grams of the crude oil blend in the same way as the first time. The same filter membrane in the first time was used in the second filtration. The final dried solid powder weighed 3.21 grams, gaining the total solid weight of 0.21 grams, or 700 ppm based on the crude oil blend.

The green coke powder used in this experiment has an average particle size of 8 μm and the carbon content of 93%. Its weight does not change much through above crude oil soaking and toluene washing processes. The crude oil blend contained 350 ppm of so-called filterable solid as determined by standard toluene dilution and washing procedure. Thus, the green coke powder adsorbed more than "solvent filterable solid".

The filtration speed was fast in both the filtrations; particularly there was apparently not any filtration resistance at washing and filtering step, indicating that the filter membrane was not clogged by any solid even after two filtration and that all the solid particles from the crude oil blend were adsorbed on the green coke sorbents. In comparison, the crude oil couldn't be directly filtered through the membrane under the same condition; the filter membrane was completely clogged up after a few minutes.

A sample of 186 grams of the filtered crude oil was mixed with 14 gram of deionized water and the mixture was heated to 70° C. and then blended with 20 ppm of a demulsifier in a Waring® blender at 8000 rpm for 16 seconds. The resulting emulsion was poured into two portable electrostatic desalter tubes, and 600 volts (DC) was applied to accelerate dehydration of the emulsion. For comparison, the same crude oil blend without the above filtration was subjected to the same process. After 90 minutes, the voltage was turned off and the tubes were visually examined to determine the dehydration condition. These tubes were placed in a centrifuge and spun at 16000 rpm for 20 minutes so that water and crude oil was completely separated. A sample of 5 ml of the desalted water was taken from each tube and diluted with 50 ml of deionized water and the ionic conductivity of the diluted water samples was measured with an ionic conductivity meter.

After 90 minutes of electrostatic desalting and centrifuge, the inventive sample was clear while the conventional sample was cloudy. Even though all the water has apparently been separated out for both the cases, there is a big particle cloud suspending between water and oil layers in the case with the crude oil whereas the separation between water and crude oil is very clear in the case with the solid removed crude oil. On the other hand, the ionic conductivity of the DI deionized water, the desalted water from the crude oil that from the solid-removed crude oil was 64, 91, and 777 μS, respectively. As the ionic conductivity value reflects the total salt concentration in the desalted water; the remaining salt in the solid removed crude oil is about 4% of the original content ((91−64)/(777−64)*100).

It is been demonstrated that green coke particles in this case actually also adsorbed ultrafine water droplets in the crude oil because these water droplets are typically coated with large and polar molecules that are really akin to polar coke surfaces.

Example 2

A sample of 250 grams of a light crude oil from a refinery desalting unit were mixed with 5 grams of a green coke powder in a 500 ml Erlenmeyer flask on a hot plate with a magnetic bar. The green coke powder has an average particle size of 8 μm and a residual carbon content of 89%. After the mixture temperature reached 70° C., the mixture was poured into a filtration vessel (2¼ inch in diameter) and filtered through a 0.5 μm sintered stainless steel disk under a pressure of 80 psi. The filtrate was collected as purified crude oil. The filtration cake was washed thoroughly with toluene and dried under vacuum at 100° C. for 14 hours. The water content and inorganic elements in the crude oils before and after adsorption/filtration were analyzed to determine the removal effectiveness of the contaminants. For comparison, the crude oil after desalting at the same refinery unit was also analyzed. The analytical results are given in Table 1 and 2

Example 3

The experiment in Example 2 was repeated with the crude oil that had been desalted from the same refinery desalting unit.

Example 4 and 5

These two examples are similar experiments to Example 2 and 3 and were conducted with a heavy crude oil from a different refinery unit. The analytical results are also listed in Table 1 and 2 for comparison.

It is worth pointing out here that the commercial desalting unit used about 6% water based on the total crude oil, which generating a waste stream of at least 6% of the total crude. For the solid sorbent adsorption process, there is not any waste generated because the contaminant-loaded sorbent can be re-used after a simple heat-treatment and the contaminant-loaded sorbent still contains at least 40% carbon and has a heating value similar to fuel grade coke. As compared in Tables 1 and 2, the solid adsorption/filtration has the following advantages over conventional desalting processes: a) it does not use water, b) it removes more salts and solids than desalting, and, c) it removes more water content from crude oils than desalting.

The above examples have elucidated the fundamental features of this invention: a) green coke powder is used as the sorbent to adsorb colloidal organic and inorganic particles including ultrafine water droplets from crude oils, b) the resulted solid particles and cleaned liquid crude oil can be easily separated continuously, c) the resulted crude oils from the process is super clean in the terms of organic and inorganic solid particles and salts.

TABLE 1

| Crude | Sample | API | Water Content (ppm) | Total Solid removed (ppm) |
|---|---|---|---|---|
| 1 | Raw | 40.5 | 1114 | |
| | Desalted | 38.7 | 622 | |
| | Adsorbed | 39.0 | 209 | 420 |
| | Desalted & Adsorbed | 38.0 | 207 | 240 |
| 2 | Raw | 15.9 | 4644 | |
| | Desalted | 15.8 | 5910 | |
| | Adsorbed | 16.6 | 1193 | 380 |
| | Desalted & Adsorbed | 16.7 | 1498 | 273 |

TABLE 2

| | | IC and ICP measurable elements in crude oil (ppm) | | | | | | | |
|---|---|---|---|---|---|---|---|---|---|
| Crude | Sample | Cl | Al | Ca | Fe | Mg | Na | Ni | V |
| | Raw | 56.5 | 1.93 | 5.66 | 10.1 | Not | 18 | 2.28 | 4.46 |
| | Desalted | 1.7 | <1.07 | 1.01 | 4.45 | Measurable | <7.89 | <2.24 | 4.44 |
| | Adsorbed | 0.6 | <1.02 | 0.727 | <3.17 | | <7.57 | <2.15 | 4.29 |
| | Desalted & Adsorbed | 0.3 | <1.02 | 1.0 | <3.17 | | <7.56 | <2.15 | 4.38 |
| | Raw | 50.7 | 1.89 | 22.3 | 5.35 | 1.84 | 35.4 | 70.8 | 287 |
| | Desalted | 5.3 | <1.03 | 5.68 | <3.20 | <1.34 | <7.65 | 70.8 | 289 |
| | Adsorbed | 3.0 | <0.996 | 6.51 | <3.09 | <1.30 | <7.37 | 71.7 | 294 |
| | Desalted & Adsorbed | 2.8 | <1.03 | 2.92 | <3.19 | <1.34 | <7.61 | 72.9 | 301 |

Some crude oils contain corrosive compounds such as various amines. These species are typically soluble in crude oil, but they would form amine salts with chloride during refinery processing, causing severe corrosion on the refinery equipment. With the solid adsorption process, these soluble basic species may also be effectively removed from crude oil by including an acidifying treatment to the green coke sorbent. This acidifying treatment may be applied in device 170 or 270 as shown in FIGS. 3 and 4. For the applications where basic species such as amines need to be removed, the atmosphere is preferably oxidative; oxygen gas and other oxidative gases such as various acids and peroxides are also introduced into the atmosphere so that carbonaceous species on the sorbent surface are oxidized to form acidic groups. These acidic groups on the sorbent surface provide the functionality of absorbing basic species such as amines from crude oils. The acidifying regenerating step would be performed in the regenerator 161.

With a blend of fresh green coke and acidified green coke particles, the same materials being adsorbed/agglomerated as first described are still being adsorbed and agglomerated, but there are now sorbent particles that also adsorb the basic or alkaline molecules, such as amines.

Examples showing the enhanced benefit of this aspect of the invention include:

Example 6

200 grams of Albian synthetic heavy crude oil were mixed with 4 grams of a green coke powder in a 500 ml Erlenmeyer flask on a hot plate with a magnetic bar. After the mixture temperature reached 80° C., the mixture was poured into a filtration vessel (2¼ in diameter) and filtered through a 0.5 μm sintered stainless steel disk under a pressure of 80 psi. The filtrate was collected as purified crude oil. The filtration cake was washed thoroughly with toluene and dried under vacuum at 100° C. for 14 hours. The dried powder weighed 4.2176 grams, yielding the total solid particle and salt content of 0.2176 grams or 1 088 ppm of the crude oil.

The solid powder was transferred into a ceramic crucible, placed in a tube furnace, and heated under nitrogen gas atmosphere at 450° C. for three hours. The weight of the solid powder was measured before and after the heating, yielding a loss of 39% based on the adsorbed solid particles.

The crude oils and the solid powders before and after adsorption were analyzed for their elemental compositions with Inductively Coupled Plasma Atomic Emission Spectroscopy and water content by Karl Fischer titration. Table 3 shows comparison of the compositions.

Example 7

Example 6 was repeated with the used and heat-treated sorbent from Example 6. The weight gain on the solid sorbent showed that 1070 ppm of the solid particles were removed by the adsorption from the crude oil in this case. The solid powder was again subjected to the same heat treatment as Example 6. The elemental compositions and water content of the purified crude oil are also given in Table 3 for comparison.

Example 8

After Example 7 was repeated three times with the same sorbent, instead of washing residual crude oil from the wet solid cake with toluene, the wet solid cake was directly dried under vacuum at 100° C. for 15 hours, and then the dried solid powder was heated under the same condition as Example 1. Example 2 was then repeated using this solid powder. The weight gain on the solid powder from the adsorption showed a solid removal of 1091 ppm from the crude oil. The elemental composition and water content of the purified crude oil is listed in Table 3.

As shown in Table 3, Except for Ca, Ni, and V, all the other detectable inorganic elements have been adsorbed and removed from the crude oil to below detectable level, even those undetectable elements are also clearly adsorbed and transferred on the solid sorbent. For Ca, Fe, and V, only a small portion was adsorbed by the solid sorbent, possibly because they exist in chelates in the crude oil. From the first four columns, it can be easily calculated that the amounts of those elements concentrated on the solid sorbent are equal to the corresponding amount from the raw crude oil ((the 1st column−2nd column)×50=−($4^{th}$ column−3rd column)). Except for the first adsorption with fresh sorbent, the water content in the crude oil was also reduced after adsorption. The fresh green coke powder used in the first example might contain some moisture because the sample has been stored at ambient condition for many years before use, resulting in addition of trace water.

Comparative Example

A typical desalting experiment was conducted with the same crude oil in this example for comparison. A sample of 2400 grams of the crude oil were mixed with 20 ppm of the demulsifier (Nalco EC 2472A) and heated to 90° C. and blended with 7% deionized water at 8000 rpm for 16 seconds. The resulting emulsion was pumped into/through a laboratory electrostatic desalter at a rate of about 700 grams per hour. A voltage of 1000 volts was applied to the grids of the desalter during desalting. However, there was not any separation between water and oil during the experiment (about three hours). Thus, the crude oil could not be desalted with the conventional method.

The above examples have elucidated the fundamental features of this invention: solid sorbents can be used effectively to adsorb solid particles, salts, and water in crude oils and the consumed sorbent can be regenerated by thermal treatment.

TABLE 3

| | Composition (Wt ppm) | | | | | |
|---|---|---|---|---|---|---|
| | | Example 1 | | | | |
| Element | Raw Crude Oil | Purified Crude | Fresh coke sorbent | Sorbent after adsorption | Example 2 Purified Crude | Example 3 Purified Crude |
| Al | 30.5 | 1.15 | 28.9 | 1710 | <1.02 | <1.03 |
| B | <5.19 | <5.10 | <5.27 | <5.36 | <5.21 | <5.25 |

TABLE 3-continued

| | Composition (Wt ppm) | | | | | |
|---|---|---|---|---|---|---|
| | | Example 1 | | | | |
| Element | Raw Crude Oil | Purified Crude | Fresh coke sorbent | Sorbent after adsorption | Example 2 Purified Crude | Example 3 Purified Crude |
| Ba | <3.05 | <3.00 | 4.87 | 14 | <3.07 | <3.09 |
| Ca | 6.95 | 2.8 | 22.2 | 173 | 1.2 | 1.11 |
| Cd | <2.03 | <2.00 | <2.07 | <2.10 | <2.05 | <2.06 |
| Co | <2.24 | <2.20 | <2.27 | 8.73 | <2.25 | <2.26 |
| Cr | <4.58 | <4.50 | <4.65 | 37.4 | <4.60 | <4.63 |
| Cu | <1.12 | <1.10 | <1.14 | 3.57 | <1.13 | <1.13 |
| Fe | 59 | <3.10 | 45.2 | 2780 | <3.17 | <3.19 |
| K | <29.3 | <28.8 | <29.8 | 128 | <29.4 | <29.6 |
| Li | <1.12 | <1.10 | <1.14 | 1.2 | <1.13 | <1.13 |
| Mg | 1.68 | <1.30 | 4.75 | 87.4 | <1.33 | <1.34 |
| Mn | 1.16 | <0.300 | 0.737 | 55.2 | <0.307 | <0.309 |
| Mo | 12 | <3.10 | <3.20 | 438 | <3.17 | <3.19 |
| Na | <7.52 | <7.40 | 14 | 233 | <7.57 | <7.61 |
| Ni | 47.1 | 35.8 | <2.17 | 548 | 36.3 | 35.7 |
| P | <7.12 | <7.00 | <7.23 | 28.7 | <7.16 | <7.20 |
| Sr | <0.305 | <0.300 | <0.310 | 4.4 | <0.307 | <0.309 |
| Ti | 4.33 | <2.10 | 3.39 | 126 | <2.15 | <2.16 |
| V | 81.4 | 67.2 | 4.24 | 684 | 69.4 | 67.9 |
| Zn | 1.78 | <0.400 | <0.413 | 101 | <0.409 | <0.411 |
| Zr | <1.53 | <1.50 | <1.55 | 3.56 | <1.53 | <1.54 |
| $H_2O$ | 2006 | 2013 | Not Measured | | 1663 | 1595 |

The process is particularly applicable to removing solid particles and salt-containing water droplets from bio-sourced oils or biofuel crude oils. The solid sorbents are dispersed in crude oil such that solid sorbent particles and crude oil has sufficient contact, resulting in full adsorption of the solid particles (ultrafine and micron sized organic and inorganic solid material) in the crude oil. The resulting solid sorbent and liquid crude oil is separated continuously or semi-continuously through filtration. The details are described below.

Referring to FIG. 1, the process according to this invention includes two simultaneous major steps: (a) mixing solid sorbent with crude oil and (b) separating impurity solid and salt particle-loaded sorbent particles from liquid crude oil. The special sorbent materials according to this invention enable such operation to be effective and economically viable.

Green coke particles were found to be effective in adsorbing colloidal organic and inorganic solid particles as well as ultra-fine water droplets in fossil crude oils (see the related IR). In this invention, green coke particles are also good at adsorbing the impurity solid particles and water droplets in biofuel crude oil. The impurity solid and salts-adsorbed coke particles can be easily separated from liquid crude oil by any mechanic method such as filtration and the resulting biofuel crude oil is solid-free and can be directly processed in traditional refinery systems.

Even though conventional solid sorbents such as activated carbon or filtration aid agent such as silicate and Celite® may be used as the sorbent for this purpose, green coke particles are preferred because those conventional sorbents are relatively expensive and may not have the affinity with crude oil compared with particulate green coke materials. The so called "green coke" materials herein are petroleum cokes or charred coal tars before calcination (>1000° C.) that contain a certain amount of volatile content. Preferably the green coke has carbon content between 25% and 99.0%, more preferably between 75% and 98%. The amount of volatile content in a green coke may reflect the mechanic strength of green coke particles and the affinity of such coke surface with crude oil; a too high volatile content may lead to too weak mechanic strength of green coke particles, which may cause breaking-up of particles on collision of particles. A too high carbon content (e.g. >99.5%) may yield a low affinity with crude oils, which may have a low adsorption ability for large and polar molecules that are preferably removed from crude oil.

It should be pointed out here that the above sorbent or green coke materials may also contain significant amount of inorganic solids, the carbon content aforementioned is the hydrocarbon portion in the sorbent.

The size of green coke particles is important factor in determining adsorption rate and maximum loading of adsorbed solid particles. The smaller the particle size the larger the surface area and the faster for adsorption. However, the smaller particle size also may lead to the denser filtration cake layer on the filtration screen, resulting in a slower liquid flow rate. To achieve a fast adsorption rate and a good liquid flow through the filtration screen, the average green coke particle size is preferably between 3 and 500 μm, more preferably between 5 and 50 μm.

Now, referring to FIG. 1 for the process, mixing and filtration is simultaneously conducted and the solution near the filter screen is agitated so that a thick filtration cake layer would not build on the filter screen. Particle-loaded sorbent materials may be continuously removed from the bottom section while fresh sorbent material is also continuously added and mixed with incoming crude oil. Alternatively, two filter tanks may be used sequentially; one is operated on filtration mode while other one is operated on removing particle-loaded sorbent material.

Example 9

A sample of 60 grams of an algae biofuel crude were mixed with 1.55 grams of a green coke powder in a 250 ml Erlenmeyer flask on a hot plate with a magnetic bar. After the mixture temperature reached 90° C., the mixture was poured into a filtration vessel (2¼ inch in diameter) and filtered through a 0.5 gm sintered stainless steel disk under a pressure of 80 psi. The filtrate was collected as purified algae crude oil. The filtration cake was washed thoroughly with toluene and dried under vacuum at 100° C. for 14 hours. The dried powder weighed 1.67 grams, yielding the total solid particle and salt content of 0.12 grams or 0.2% of the algae crude oil.

The element contents in the purified algae crude oil, the solid powder, and the substrate green coke powder were analyzed using an inductively coupled plasma atomic emission spectroscopy; a comparison of the results are given in Table 1. It can be seen that the inorganic elements such as Al, Ba, Ca, and P, etc. have been effectively removed from the liquid crude, whereas only a small fraction of the elements such as Cu, Fe, Ni, and Zn were removed, possibly these transition metals exist as chelated compounds in the liquid.

The above example has elucidated the fundamental features of this invention: a) green coke powder is used as the sorbent to adsorb solid particles and salts from biofuel crude oil, specifically algae crude oils and b) the resulted solid particles and purified liquid crude oil can be easily separated through filtration.

TABLE 4

| Sample Elements | Purified algae crude oil | Filtration solid | Green coke powder | Removed (%) |
|---|---|---|---|---|
| | Content by weight (ppm) | | | |
| Al | <11.1 | 3710 | 28.9 | 99.2 |
| B | <5.26 | <5.25 | <5.27 | |
| Ba | <3.10 | 47.3 | 4.87 | 89.7 |
| Ca | 50.7 | 5640 | 22.2 | 73.3 |
| Cd | <2.06 | <2.06 | .07 | |
| Co | <2.276 | <2.26 | <2.27 | |
| Cr | <4.64 | 53.6 | <4.65 | 100.0 |
| Cu | 19 | 19.7 | <1.14 | 2.5 |
| Fe | 1170 | 2440 | 45.2 | 4.9 |
| K | 53.6 | 1660 | <29.8 | 43.6 |
| Li | <1.14 | 2.5 | <1.14 | 100.0 |
| Mg | 32.9 | 1800 | 4.75 | 57.6 |
| Mn | 4.82 | 131 | 0.737 | 40.2 |
| Mo | <3.20 | 12.5 | <3.20 | 100.0 |
| Na | 181 | 955 | 14 | 11.5 |
| Ni | 31.2 | 74.2 | <2.17 | 5.6 |
| P | 15.4 | 3840 | <7.23 | 86.2 |
| Sr | <0.310 | 71.7 | <0.310 | 100.0 |
| Ti | <2.17 | 172 | 3.39 | 98.0 |
| V | <4.23 | 8.67 | <4.24 | 100.0 |
| Zn | 52.9 | 87.4 | <0.413 | 4.0 |
| Zr | <1.55 | 5.76 | <1.55 | 100.0 |

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for removing contaminants and basic or alkaline species contaminants from petroleum crude oil comprising:

a) adding a green coke containing solid sorbent to crude oil where the crude oil moves through a contained space and the solid sorbent is added to the contained space to move with the crude oil where at least some of the solid sorbent has been partially oxidized;

b) mixing the crude oil and solid sorbent with a mixer;

c) agglomerating/adsorbing solid contaminants from the crude oil to the solid sorbent wherein basic or alkaline species contaminants are also adsorbed to the oxidized solid sorbent; and d) removing the solid sorbent with agglomerated contaminants from the contained space and from the crude oil.

2. The process according to claim 1 wherein the solid sorbent is solid hydrocarbon material.

3. The process according to claim 2 wherein the green coke has an average size of between 1 and 250 microns.

4. The process according to claim 2 wherein the green coke has an average size of between 3 and 50 microns.

5. The process according to claim 2 wherein the green coke has an average size of between 5 and 25 microns.

6. The process according to claim 1 wherein the solid sorbent is a mixture of green coke and recycled green coke that has been subjected to an inert heating process to liberate/pyrolizing contaminants from a previous contaminant adsorption process.

7. The process according to claim 6 wherein the mixture of green coke and recycled green coke has an average size of between 1 and 250 microns.

8. The process according to claim 6 wherein the mixture of green coke and recycled green coke has an average size of between 3 and 50 microns.

9. The process according to claim 5 wherein the mixture of green coke and recycled green coke has an average size of between 5 and 25 microns.

10. The process according to claim 1 further including a step of de-wetting the solid sorbent with containments agglomerated thereon so as to remove any residual crude oil from the solid sorbent.

11. The process according to claim 9 further including the step of heating the solid sorbent to liberate the contaminants from the solid sorbent and to prepare the solid sorbent for recycling for re-use as solid sorbent in the contaminant removal process.

12. The process according to claim 10 further including the step of separating undersized solid sorbent particles prior to recycling the solid sorbent so as to maintain a desired particle size for the solid sorbent used in the contaminant removal process.

13. The process according to claim 1 wherein the solid sorbent is selected to have a density of between 0.5 g/cc and 7 g/cc.

14. The process according to claim 1 wherein the solid sorbent is selected to have a density of between 0.7 g/cc and 2.0 g/cc.

15. The process according to claim 1 wherein the solid sorbent is selected to be partially or almost totally hydrocarbon materials that contain a residual carbon content of at least 40%.

16. The process according to claim 1 wherein the solid sorbent is selected to be partially or almost totally hydrocarbon materials that contain a residual carbon content of between 75% and 99%.

17. The process according to claim 1 wherein the solid sorbent is selected to be partially or almost totally hydrocarbon materials that contain a residual carbon content of between 85% and 98%.

* * * * *